United States Patent [19]

Persson

[11] Patent Number: 4,620,600

[45] Date of Patent: Nov. 4, 1986

[54] DRILL ARRANGEMENT

[76] Inventor: Jan E. Persson, Henriksdalsringen 17[5], S-131 32 Nacka, Sweden

[21] Appl. No.: 649,731

[22] Filed: Sep. 12, 1984

[30] Foreign Application Priority Data

Sep. 23, 1983 [SE] Sweden ..... 8305147

[51] Int. Cl.[4] ..... E21B 7/00

[52] U.S. Cl. ..... 175/73; 175/398; 175/399

[58] Field of Search ..... 175/73, 76, 231, 257, 175/398, 399, 408; 166/71

[56] References Cited

U.S. PATENT DOCUMENTS

| | | | |
|---|---|---|---|
| 3,174,563 | 3/1965 | Edblom et al. | 175/399 X |
| 3,199,616 | 8/1965 | Hjälsten | 175/398 X |
| 3,277,972 | 10/1966 | Lagerström | 175/399 |
| 3,416,616 | 12/1968 | Ahlgren | 175/399 X |
| 3,753,470 | 8/1973 | Lagerstrom et al. | 175/292 |
| 3,848,683 | 11/1974 | Persson | 175/258 X |
| 4,183,415 | 1/1980 | Stenuick | 175/257 X |

FOREIGN PATENT DOCUMENTS

| | | | |
|---|---|---|---|
| 0002160 | 5/1979 | European Pat. Off. . | |
| 186571 | 12/1963 | Sweden . | |
| 7201588 | 7/1975 | Sweden . | |
| 1050116 | 12/1966 | United Kingdom | 175/398 |

*Primary Examiner*—Stuart S. Levy
*Assistant Examiner*—David Werner
*Attorney, Agent, or Firm*—Ostrolenk, Faber, Gerb & Soffen

[57] ABSTRACT

The invention relates to an arrangement for drilling in soil and rock while simultaneously lining the drill hole with a lining tube. The arrangement includes an asymetric guide which is non-rotatably connected to a drill stem or like element, and an eccentric drill bit or crown which is journalled for limited rotation in the guide. The guide is arranged to lie solely against a part of one side of the inner surface of the lining tube during a drilling operation. Advantageously, the guide is supplemented with a guiding portion on the shank part of the drill bit located opposite the first guide. The drill arrangement enables wide adjustments to be made to the eccentric setting of the drill bit, and makes possible an advantageous forming of the cutting geometry of the drill bit.

10 Claims, 7 Drawing Figures

DRILL ARRANGEMENT

BACKGROUND OF THE INVENTION

This invention relates to a drilling arrangement, and particularly to such an arrangement suitable for drilling operations in earth or rock involving simultaneous lining of the drill hole with a lining tube. The arrangement may be suitable for rotational drilling operations or for percussion-rotation drilling.

DESCRIPTION OF THE PRIOR ART

When drilling, for example, water wells, it is more often than not desirable to line the drill holes along a significant part of their vertical extension. However, the drilling of holes while simultaneously lining the drill holes with a lining tube is a highly complicated undertaking, because, among other reasons, the formations to be drilled often vary greatly and are highly complicated. In addition it must be possible to penetrate all kinds of formations, such as loose-lying sand; hard, viscous and swelling clay formations; alluvial conglomerates with rounded small stones or pebbles; morains with small and large boulders; fissured zones in rock etc. Good drilling properties in hard rock are also desirable, since it is often necessary to line drill holes along considerable lengths thereof even in rock, for example, in such regions as those where, as a result of geological displacements, layers of clay may be present therebeneath.

Drilling arrangements intended for the aforesaid purpose should fulfill a number of requirements or desiderata. For example, the drilling arrangements should be capable of crushing rock and stones effectively and with the minimum of intrinsic wear and/or be capable of operating in hard, swelling clays. The drilling arrangement should also be designed to provide effective transport of the drill cuttings up through the lining tube, while protecting the lining tube against undue damage. In particular, the loads acting on the lower end of the lining tube, should desirably be so limited that even plastics tubing can be used to form the lining. The lower end of the lining tube is particularly subjected to strain, partly as a result of lateral forces emanating from a drill guide, which tend to damage the lining tube, which may lead the hole obliquely, and partly due to wear caused by the crushing of coarse cuttings or by erosion of finer cuttings between the guide and the lining tube. Finally, a suitable drilling arrangement should be easily handled, uncomplicated and, above all, reliable, to ensure, for example, that the drill bit or crown does not lock in its drilling position or become unscrewed and drop into the hole when the bit is withdrawn and the drilling arrangement lifted out of the hole.

Previously proposed drilling arrangements for use together with lining tubes have normally required the provision of a circular guide aligned centrally in the lining tube, and have often also required the provision of a separate pilot drill-bit, in order to guide the drilling arrangement satisfactorily. One example of such an arrangement is described in Swedish Patent Specification 377 706. Other, previously proposed drilling arrangements have included a drill bit or crown which is fixed relative to the drill stem, and an eccentric guide which is arranged for limited rotational movement. Examples of such arrangements are found described in Swedish Patent Specifications 188 739 and 212 006. Such rotatable, eccentric guides, however, are readily locked by cuttings, thereby preventing the drill bit from being withdrawn upon termination of a drilling operation. Alternatively, it has been necessary to so design the guide as to render upward transportation of the cuttings through the lining tube totally impossible; c.f. the aforementioned Swedish Patent Specification 212 006.

SUMMARY OF THE INVENTION

An object of the present invention is at least to obviate the problems experienced with prior drilling arrangements.

Accordingly, the invention provides an arrangement for drilling a hole in soil and/or rock while simultaneously lining the drilled hole with a lining tube, said arrangement comprising an energy transfer means in the form of a sinker bore hammer, a drill stem or like element; a guide adjacent one end of said means; and an eccentrically mounted drill bit, the drill bit being mounted to cooperate with said guide for limited rotation between a first terminal position, constituting an extended drilling position in which a cutting part of the drill bit produces in front of the lining tube a hole whose diameter is greater than the outer diameter of the lining tube, and a second terminal position that constitutes a withdrawn position in which the drill bit, together with the guide is accommodated within the lining tube and can be withdrawn therethrough, the guide being non-rotatably connected to the energy transfer means and the drill bit being mounted for limited rotation relative to the energy transfer means through an angle of rotation of at least 90°.

Desirably, the drill bit is journalled for limited rotation relative to the guide.

The drill arrangement can be coupled to a succession of drill rods which transmit the rotary movement and, when applicable, percussion energy from a percussion apparatus located externally of the hole, or can be coupled directly to a down-the-hole hammer located in the hole.

A drill arrangement according to the invention differs from previously known drilling arrangements of this kind because the guide for the drill bit is non-rotatably connected to the energy transfer means (the drill stem), and because the drill bit is limitedly rotatably mounted at the end of said energy transfer means. Preferably, the drill bit is mounted for limited rotation relative to said energy transfer means through an angle of 180°.

In the drilling position, the peripheral part of the guide lying against the inner surface of the lining tube is located substantially diametrically opposite that part of the drill bit which exhibits the highest eccentricity in relation to the centre line of the lining tube. Among other things, this particular design of the guide provides space for considerable eccentric displacement of the drill bit, which in turn provides for an additional advantageous form of the cutting geometry of the drill bit.

In order that the invention may be more readily understood, and so that further features thereof may be appreciated, a drill arrangement embodying the invention will now be described, by way of example, with reference to the accompanying drawings; in which:

DESCRIPTION OF THE PREFERRED EMBODIMENT

Figure 1:
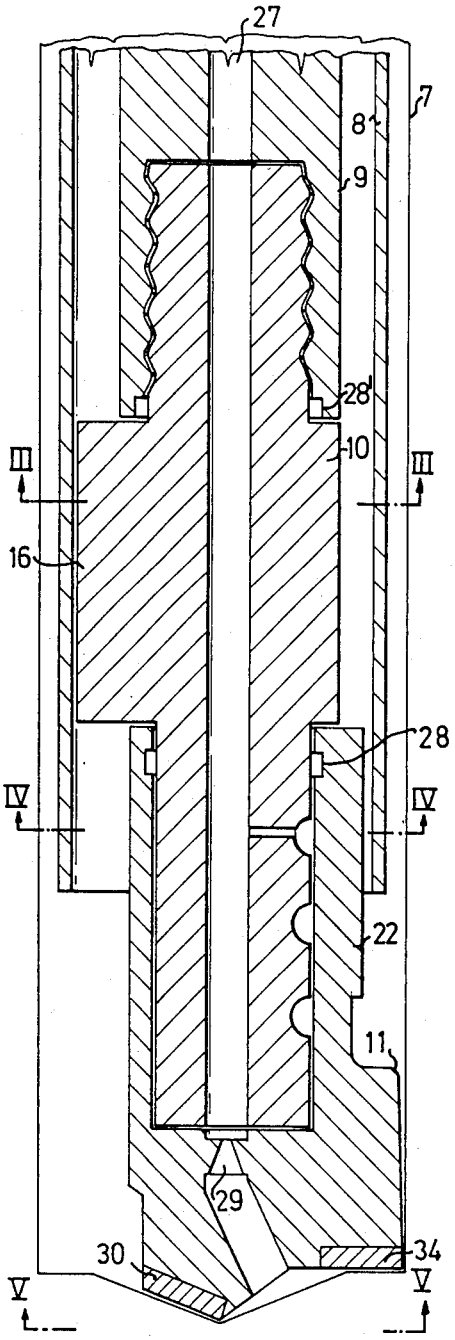
FIG. 1 is an axial sectional view of a drilling arrangement according to the invention, taken through the most eccentric part of the drill bit, and shown in the drilling position.
Figure 2:
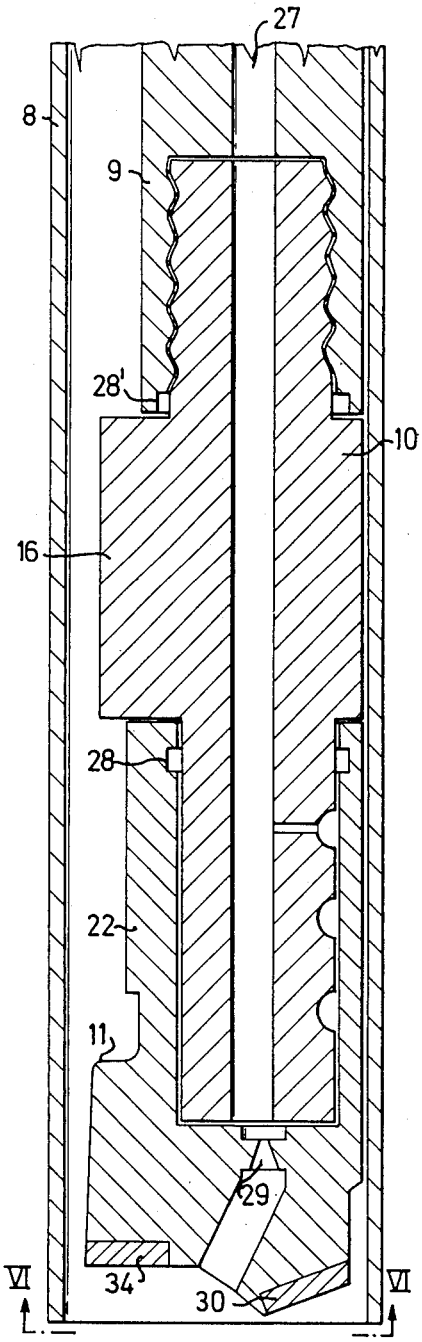
FIG. 2 is a sectional view similar to that of FIG. 1 but with the drilling arrangement shown with the drilling bit in its withdrawn position, i.e. with the drill bit rotated through 180° and drawn into the lining tube.

In the Figures, the theoretic hole-contour of a drilled hole is indicated 7. A lining tube 8 is shown in position within the drilled hole in cooperation with the lower part 9 of a drill stem, a guide 10 and a drill bit or drill crown 11. As will be explained further below, the drill bit is movable selectively, between an operating position, in which the drill bit extends beyond the lining tube 8, and a withdrawn position, in which the drill bit is located within the lining tube. The drill bit is mounted eccentrically of the axis of rotation of the drill string so that, during a drilling operation the hole 7 is drilled to have a radius large enough to receive the lining tube 8.

As shown in FIG. 1, the guide 10 present an upwardly extending shaft which is narrower than the main part of the guide. This shaft is provided with external screw threads which mesh with corresponding screw threads provided in a bore of the drill stem 9, thereby enabling the guide 10 and the drill bit 11, which is attached to the guide 10, to be removably fixed to the drill stem 9. The screw connection between the guide 10 and the drill stem 9 is not rotatable under normal conditions, and can only be loosened with the aid of a tool after the drilling arrangement has been withdrawn from the drill hole or bore. The guide 10 also presents a downwardly extending cylindrical shaft, which is also narrower than the main part of the guide. The drill bit 11 is provided with a hollow shank, which is adapted to embrace the downwardly extending shaft of the guide and is secured thereto in such a manner as to permit only limited rotational movement of the drill bit relative to the said downwardly extending shaft.

As will be seen from FIG. 1, the guide 10 is so formed that, in the drilling position, the drill stem 9 is out of alignment with the centre of the lining tube 8, and is offset in a direction towards that part of the drill bit which exhibits the highest degree of eccentricity. Among other things, this offsetting of the drill bit 11 affords a more uniform distribution of the loads on the head of the drill bit in percussive drilling operations.

Figure 3:
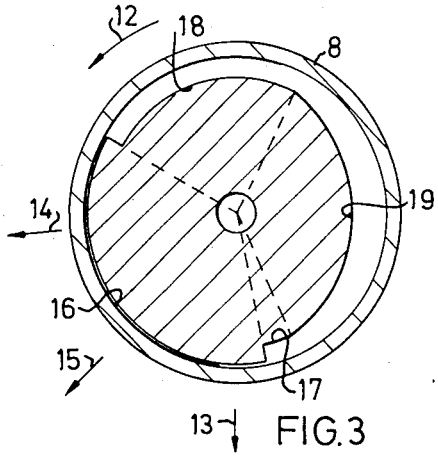
FIG. 3 is a radial sectional view of the arrangement, taken along the line 3—3 in FIG. 1.
Figure 4:
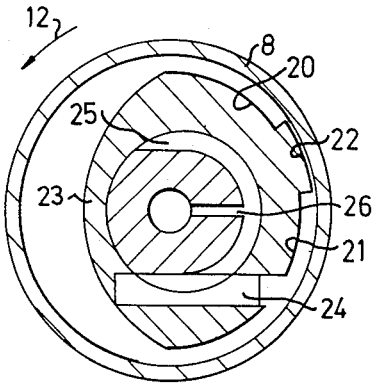
FIG. 4 is a radial sectional view of a shank portion of the drill bit and the eccentric shaft of the guide, taken on the line 4—4 in FIG. 1.
Figure 5:
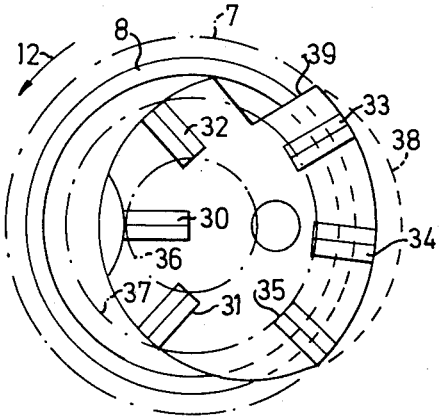
FIG. 5 is an end view of the drill-head of the drill bit and the lining tube taken in the direction 5—5 in FIG. 1.

The arrows 12 in FIGS. 3 to 5 illustrate the direction of rotation of the drill bit 11 during a drilling operation. In FIG. 3, the arrow 13 indicates the force with which the guide 10 is urged against the lining tube 8 as a result of torque required to rotate the drill bit, the arrow 14 indicates the force with which the guide is pressed against the lining tube 8 as a result of the pressure of the bit against the peripheral wall of the hole and the arrow 15 indicates the resultant of forces 13 and 14.

The guide 10 has an irregular cross-section, the periphery comprising a circular-arcuate sector 16, which defines a surface part of the guide that lies in abutment with the lining tube 8 during a drilling operation, guide sectors 17 and 18, each of which is spaced from the lining tube 8 during drilling to present a gap of uniform width, and a circular-arcuate sector 19 of the guide periphery which presents to the lining tube 8 a gap of varying width, where the width of the gap at the central region of said sector is greater than that presented by the guide sectors 17 and 18. The contour of the guide-sector 19 conforms with the interior profile of the lining tube 8, when the drill bit occupies its withdrawn position in the lining tube, as will be described.

As best shown in FIG. 4, when the drill bit 11 is in its operative position, sectors 20, 21 of the shank of the drill bit are uniformly spaced from the respective sectors 17, 18 of the guide and the lining. A circular-arcuate sector 22 of the shank periphery, that lies between the sectors 20 and 21 affords supplementary guidance of the drill bit by cooperation with the lining tube during a drilling operation. A circular-arcuate sector 23 of the shank periphery presents a gap of varying width to the lining tube 8, the width of said gap in the centre region of the sector being greater than the width of the gaps presented by the respective sectors 20 and 21. The contour of the sector 23 conforms to the interior contour of the lining tube 8 when the drill bit occupies its withdrawn position within the lining tube.

A locking element 24, in the form of a circular cylindrical rod mounted in the shank of the drill bit, is received within a groove 25 in the downwardly extending eccentric shaft of the guide. The locking element 24 is so formed that the drill bit can be turned through 180°, i.e. between the aforesaid drilling position and the aforesaid withdrawn position, but is locked against axial movement relative to the guide. When assembling the drill arrangement, the locking element can be secured to the bit shank by means of welds. An air-flushing channel 26, connects a central air-flushing channel 27 with the groove 25 and with the bearing gaps between the bitshank and the guide 10, thereby facilitating lubrication and cleansing operations.

As will be seen from FIG. 1, two further grooves, which correspond to the groove 25 and which are intended to co-act with further locking elements in the bit-shank, in the manner aforedescribed with reference to locking element 14, are formed in the eccentric shaft of the guide beneath the grooves 25 so that, for the sake of safety, loads are distributed over a number of locking elements and corresponding grooves.

The central air-flushing channel 27 extends through the drill bit 11, the guide 10 and the drill stem 9. A check valve, not shown, is suitably arranged at 29 in the drill bit 11 and grooves 28, $28^1$ having outwardly facing lips are provided to accommodate sealing rings within the bit shank and the drill stem respectively. The check valve, and the seals permit flushing air to pass out from the central air-flushing channel while preventing the ingress of water and drill cuttings.

As shown in FIG. 5, the drill head portion of the drill bit 11 is also non-circular in cross section and has a number of hard metal inserts 30 to 33 for effecting the actual boring/stone crushing work. A central one 30 of the cutting inserts works within a circle represented at 36 in the drawing. Likewise inserts 31 and 32 work within a circle 37 that is located outside of the circle 36. The inserts 33, 34 and 35, termed the pre-cutting inserts, work between the circle 37 and the periphery 7. Thus, the number of cutting inserts is approximately proportional to the areas between the circles, which provides for uniform wear on, and consequently the best possible use of, the hardmetals.

Figure 6:
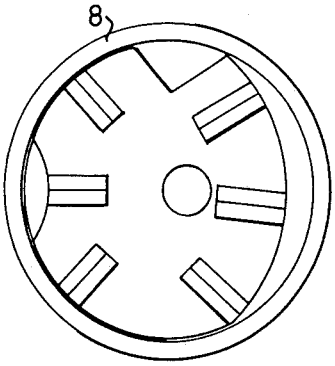
FIG. 6 is an end view of the drill-head of the drill-bit and the lining tube, taken in the direction 6—6 in FIG. 2 and rotated one half revolution so as to be more readily comparable with the position illustrated in FIG. 5.

The maximum eccentric extension which the drill head per se can be given whilst still being able to be fully accommodated within the lining tube 8 in the withdrawn position of the drill bit (as shown in FIG. 6) is indicated by broken line 38. However, it will be appreciated that the maximum possible eccentricity has not been utilised, and instead that a crescent shaped segment has been cut away so that the most eccentric peripheral part of the drill head provides a suitably large hole in relation to the outer diameter of the lining tube. This provides a non-peripheral part of the drill head which works against the periphery of the hole or bore and enables a large number of hardmetal cutting inserts to be arranged at the periphery, thereby enabling the desired diameter of the hole to be maintained over a far longer period of time, despite any wear on the drill head and thus acts to extend the useful life of the drill bit. Diametrical wear is often a factor which limits the useful life of the drill bit. A longer peripheral part and an increased number of peripheral cutting inserts will also provide for smoother and less jerky rotary movement. A front shoulder 39 of the drill head defines the outermost point of connection of the drill head with the outer diameter of the hole or bore in the direction of rotation. Because of the discontinuous transition of the front should 39, wedging contact with the drill hole, which might otherwise create a "crushing zone", is avoided. The avoidance of this "cutting zone" is highly contributory in reducing peripheral wear on the drill head and reduces the amount of torque required to rotate the drill head and results in a decreased tendancy to wedge and thus less jerky rotation of said drill head.

Figure 7:
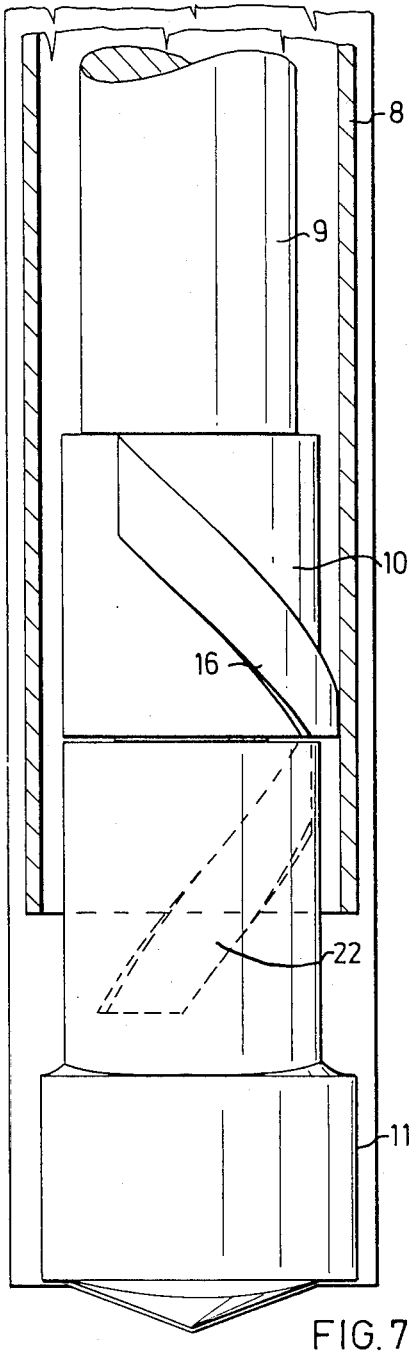
FIG. 7 is an axial sectional view of a drilling arrangement according to a second embodiment of the invention taken through the most eccentric part of the drill bit and shown in the drilling position; and showing a structure wherein the first guide surface abutting the lining tube has the form of a helical spline operable as a screw to carry drill cuttings upward within the lining tube during a drilling operation with normal direction of rotation.

The three cutting inserts 30, 31 and 32 are placed on one side of the drill head and are obliquely positioned to form a cone in the centre of the drill hole. This produces reaction forces which assist in urging the cutting inserts 33, 34 and 35, which lie substantially perpendicular to the axis of rotation of the drill bit and on the other side of the drill head, towards the periphery of the drill hole, and thus act to guide the drill bit. This reduces the forces 13, 14 and 15 acting on the guide 10, thereby relieving the load on the guide, and in addition reducing wear to provide for more uniform rotation. Consequently, the surface 16 of the guide that is adapted to abut the lining tube 8 need not be particularly large. However, the surface 16 should extend peripherally approximately up to the force lines 13 and 14, in respective directions indicated by the arrow, since these forces may vary widely in magnitude. The peripheral surface part 16 of the guide may suitably be formed as a narrow spinal land (see FIG. 7) which is obliquely positioned to operate as a screw to carry the cuttings away from the drill bit during a drilling operation. Although the guidance sector 22 of the bit shank is, in effect, superfluous when drilling homogenous material, it provides an insurance for smooth and uniform rotation in the event of the presence of irregularities in the materials being drilled. For this reason, the sector 22 also has the form of a narrow, obliquely extending or spirally formed land (see FIG. 7). When the drill bit is in its drilling position, the gaps 20 and 21 on the bit shank, and the gaps 17 and 18 on the guide form continuous gap lengths which restrict the size of the particles permitted to pass. In other respects the open space around the guide and the bit shank should be as large as possible, so as to increase the capacity of the drill arrangement to transport cuttings away, and hence the lands 16 and 22 are preferably relatively narrow.

The aforedescribed principal construction, with separate guide elements 16 and 22 provided, respectively, on the guide and the drill-bit shank, enables extensive eccentric adjustment to the drill bit, which in turn makes possible the aforementioned favourable formation of the cutting geometry, without jeopardising the necessary dimensioning of the eccentric shaft of the guide or the drill-bit shank to provide the desired mechanical strength.

The angular distance between the central part of that part of the guide periphery which lies against the inside surface of the lining tube and the central part of the most eccentric part of the drill bit, measured from the former to the latter in the direction of rotation of the drill bit during a drill operation, is suitably less than 180°, and preferably between 100°–170°, as will be understood from the above description with respect to the direction of the forces 13 and 14. The guide is also preferably so formed that in the drilling position it lies against the inside of the lining tube along a sector which corresponds to a centre angle of between 50°–150°.

The peripheral parts of the guide and the bit shank, which in the withdrawn position of the drill bit are located diametrically opposite the part of the drill bit that is most eccentric during a drilling operation, are preferably formed to enable such movement of the drill bit between the drilling position and the withdrawn position of said bit that, in the drilling position, a peripheral part of the most eccentric part of the drill bit is able to lie against the inside surface of the drill hole along a sector which corresponds to a centre angle of more than 30°, and in the withdrawn position the drill bit and the guide are accommodated within the lining tube.

In the aforementioned embodiment, the drill bit is provided with six hardmetal cutting inserts. The three cutting inserts 33–35 located at the periphery can be placed at different heights, to provide for a uniformly distributed load and cutting volume between these cutting inserts upon downward spiral movement thereof during a drilling operation. The drill bit may be provided with hardmetal pins instead of hardmetal cutting inserts, in slightly greater numbers than the hardmetal inserts of the described embodiment. When drilling is purely rotational the cutting inserts can be given a form which resembles more the form of a planing bit, in a so-called drag bit design, or can be replaced with one or more toothed rollers, in a so-called roller bit design.

To those skilled in the art to which this invention relates, changes in construction and differing embodiments and applications of the invention will suggest themselves without departing from the spirit and scope of the invention. The disclosure and the description herein are purely illustrative and are not intended to be in any sense limiting.

What is claimed is:

1. An arrangement for drilling a hole in soil and/or rock while simultaneously lining the drilled hole with a lining tube, said arrangement comprising an eccentrically mounted drill bit, an energy transfer means selected from a sinker bore hammer, a drill stem or like element, said means having a lower end transmitting the total drilling energy directly to said eccentrically mounted drill bit; and a guide adjacent and above said drill bit, the guide being non-rotatably mounted on said lower end of said energy transfer means, the drill bit being mounted on said lower end of said means for rotation in a plane perpendicular to the bore hole relative said lower end of said means, the entire drill bit being rotatable to relative to said guide between a first position constituting an eccentric drilling position in which a cutting part of the drill bit produces in front of the lining tube a hole whose diameter is greater than the outer diameter of the lining tube, and a second terminal position in which the drill bit together with the guide is accommodated within the lining tube and can be withdrawn therethrough; the angle of limited rotation of the drill bit relative the lower end and the guide being at least 90°.

2. An arrangement as set forth in claim 1, wherein the drill bit is mounted for limited rotation relative to said energy transfer means through an angle of 180°.

3. An arrangement as set forth in claim 1, wherein the drill bit is provided with central obliquely mounted cutting edges located on that part of the drill bit which is situated diametrically opposite its most eccentric part, the frontal parts of said cutting edges being located close to the centre of the hole to be drilled to provide a guiding force, which acts to press the most eccentric part of said drill bit against the periphery of said hole during a drilling operation.

4. An arrangement as set forth in claim 1, wherein the periphery of the most eccentric part of the drill bit lies on a circle concentric with the drill hole during a drilling operation, and in that a plurality of peripheral cutting edges are provided to cut at the periphery of the drill hole.

5. An arrangement as set forth in claim 1, wherein a portion of a shank of the drill bit is adapted to cooperate with a part of said lining tube to provide enhanced guidance of the drill bit operation.

6. An arrangement as set forth in claim 5, wherein the said portion of the drill bit is formed to have a helical land operable as a screw to facilitate removal of cuttings from the area of the drill bit.

7. An arrangement for drilling a hole in soil and/or rock while simultaneously lining the drilled hole with a lining tube, said arrangement comprising an energy transfer means selected from a sinker bore hammer, a drill stem or like element, said means having a first lower end; a guide adjacent said first end of said means; and an eccentrically mounted drill bit, the drill bit being mounted to cooperate with said guide for limited rotation between a first terminal position, constituting an extended drilling position in which a cutting part of the drill bit produces in front of the lining tube a hole whose diameter is greater than the outer diameter of the lining tube, and a second terminal position that constitutes a withdrawn position in which the drill bit, together with the guide is accommodated within the lining tube and can be withdrawn therethrough, the guide being non-rotatably connected to the energy transfer means and the drill bit being mounted to limited rotation relative to the energy transfer means through an angle of rotation of at least 90°, the periphery of the guide being provided with a first surface, which is adapted to lie against that part of the inside surface of the lining tube, which is located diametrically opposite the most eccentric part of the drill bit in its said first position, there being a clearance between that part of the periphery of the guide which is situated diametrically opposite said first surface, and said lining tube, said clearance permitting the energy transfer means to be eccentrically displaced towards said clearance, when said drill bit is moved towards said second position.

8. An arrangement as set forth in claim 7, wherein, during a drilling operation, the centre axis of said first guide surface is displaced, so that the centre axis of the energy transfer means is eccentrically located between the centre axis of the lining tube and the most eccentrically situated part of the drill bit.

9. An arrangement as set forth in claim 8, wherein the said first guide surface abutting said lining tube has the form of a helical spline operable as a screw to carry drill cuttings upwards within the lining tube, during a drilling operation with normal direction of rotation.

10. An arrangement as set forth in claim 7, wherein the drill bit is provided with a shark having on the side thereof a peripheral part which cooperates with the inside surface of the lining tube when the drilling bit is in the first position, said peripheral part being movable to lie on the same side as said first guide surface, when the drill bit is located in its second position.

* * * * *